US012173909B2

(12) United States Patent
Day et al.

(10) Patent No.: US 12,173,909 B2
(45) Date of Patent: Dec. 24, 2024

(54) INTEGRATED SPACE CONDITIONING AND WATER HEATING/COOLING SYSTEMS AND METHODS THERETO

(71) Applicant: Rheem Manufacturing Company, Atlanta, GA (US)

(72) Inventors: Christopher Day, Colleyville, TX (US); Sivakumar Gopalnarayanan, Dallas, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 18/348,520

(22) Filed: Jul. 7, 2023

(65) Prior Publication Data

US 2023/0358415 A1 Nov. 9, 2023

Related U.S. Application Data

(63) Continuation of application No. 16/927,125, filed on Jul. 13, 2020, now Pat. No. 11,739,952.

(51) Int. Cl.
*F24D 19/10* (2006.01)
*F24D 19/00* (2006.01)
(Continued)

(52) U.S. Cl.
CPC ..... *F24D 19/1066* (2013.01); *F24D 19/00* (2013.01); *F24D 19/1084* (2013.01); *F24F 1/00* (2013.01); *F24F 2003/003* (2013.01)

(58) Field of Classification Search
CPC ..... F24F 11/54; F24F 1/0003; F24F 11/67; F24F 2221/183; F24F 2003/003;
(Continued)

(56) References Cited

U.S. PATENT DOCUMENTS 1,874,803 A 8/1932 Reed
2,375,157 A 5/1945 Wilkes et al.
(Continued)

FOREIGN PATENT DOCUMENTS

CN 1568417 A 1/2005
CN 1609518 A 4/2005
(Continued)

OTHER PUBLICATIONS

PCT, "International Search Report & Written Opinion" Application No. PCT/US2014/018699, dated Jun. 13, 2014.
(Continued)

*Primary Examiner* — Frantz F Jules
*Assistant Examiner* — Martha Tadesse
(74) *Attorney, Agent, or Firm* — Eversheds Sutherland (US) LLP

(57) ABSTRACT

Embodiments include systems and methods for heating water and cooling air simultaneously, as well as other simultaneous heating and cooling operations. An example variable refrigerant flow conditioning system includes an outdoor unit having a compressor, a condenser coil, and a fan, a water heater coupled to the outdoor unit, a first air conditioning unit coupled to the outdoor unit, and a controller. The controller may be configured to determine that a cooling operation mode is active during a first time interval, cause vapor refrigerant to be directed from the outdoor unit to the water heater and liquid refrigerant to be directed from the outdoor unit to the first air conditioning unit, determine that a heating operation mode is active during a second time interval, and cause the vapor refrigerant to be directed from the outdoor unit to both the water heater and the first air conditioning unit.

20 Claims, 7 Drawing Sheets

(51) Int. Cl.
*F24F 1/00* (2019.01)
*F24F 3/00* (2006.01)

(58) Field of Classification Search
CPC ..... F24F 2221/18; F24D 19/1066; F24D 19/1084; F24D 19/00
See application file for complete search history.

(56) References Cited

U.S. PATENT DOCUMENTS

| | | | | |
|---|---|---|---|---|
| 3,308,877 | A | 3/1967 | Gerteis | |
| 4,012,920 | A | 3/1977 | Kirschbaum | |
| 4,215,551 | A | 8/1980 | Jones | |
| 4,227,382 | A | 10/1980 | Coyne | |
| 4,238,933 | A | 12/1980 | Coombs | |
| 4,241,588 | A | 12/1980 | Murphy et al. | |
| 4,281,519 | A | 8/1981 | Spath et al. | |
| 4,293,323 | A | 10/1981 | Cohen | |
| 4,299,098 | A | 11/1981 | Derosier | |
| 4,350,024 | A | 9/1982 | Moll | |
| 4,356,706 | A | 11/1982 | Baumgarten | |
| 4,367,634 | A | 1/1983 | Bolton | |
| 4,382,368 | A | 5/1983 | Dittell | |
| 4,386,500 | A | 6/1983 | Sigafoose | |
| 4,391,104 | A | 7/1983 | Wendschlag | |
| 4,448,347 | A | 5/1984 | Dunstan | |
| 4,449,375 | A | 5/1984 | Briccetti | |
| 4,452,050 | A | 6/1984 | Pierce | |
| 4,575,001 | A | 3/1986 | Oskarsson et al. | |
| 4,599,870 | A | 7/1986 | Hebert et al. | |
| 4,645,908 | A | 2/1987 | Jones | |
| 4,693,089 | A | 9/1987 | Bourne et al. | |
| 4,943,003 | A | 7/1990 | Shimizu et al. | |
| 5,003,788 | A | 4/1991 | Fischer | |
| 5,036,676 | A | 8/1991 | Dudley | |
| 5,050,394 | A | 9/1991 | Dudley et al. | |
| 5,081,846 | A | 1/1992 | Dudley et al. | |
| 5,086,624 | A | 2/1992 | Matsuoka et al. | |
| 5,105,633 | A | 4/1992 | Briggs | |
| 5,159,817 | A | 11/1992 | Hojo et al. | |
| 5,269,153 | A | 12/1993 | Cawley | |
| 5,277,034 | A | 1/1994 | Hojo et al. | |
| 5,495,723 | A | 3/1996 | MacDonald | |
| 5,511,723 | A | 4/1996 | Toshio et al. | |
| 5,526,649 | A | 6/1996 | Sada | |
| 5,575,159 | A | 11/1996 | Dittell | |
| 5,628,200 | A | 5/1997 | Pendergrass | |
| 5,755,111 | A | 5/1998 | Toyama | |
| 5,906,104 | A * | 5/1999 | Schwartz | F25B 6/02 62/238.7 |
| 6,357,245 | B1 | 3/2002 | Weng et al. | |
| 7,040,108 | B1 | 5/2006 | Flammang | |
| 7,594,409 | B2 | 9/2009 | Hayashi et al. | |
| 7,721,560 | B2 | 5/2010 | Carpenter | |
| 8,037,931 | B2 | 10/2011 | Penev et al. | |
| 8,356,481 | B2 | 1/2013 | Penev | |
| 9,003,818 | B2 | 4/2015 | Choi et al. | |
| 9,188,373 | B2 | 11/2015 | Garrabrant | |
| 9,377,224 | B2 | 6/2016 | Tamaki et al. | |
| 9,389,000 | B2 | 7/2016 | Leete et al. | |
| 9,416,980 | B2 | 8/2016 | Yan et al. | |
| 9,528,713 | B2 | 12/2016 | Koge et al. | |
| 9,879,881 | B2 | 1/2018 | Hawkins et al. | |
| 9,933,170 | B2 | 4/2018 | Wong | |
| 10,871,307 | B2 | 12/2020 | Hawkins et al. | |
| 2002/0092311 | A1 | 7/2002 | James | |
| 2004/0144528 | A1 | 7/2004 | Kunimoto et al. | |
| 2004/0177628 | A1 | 9/2004 | Kurata et al. | |
| 2005/0109490 | A1 | 5/2005 | Harmon et al. | |
| 2005/0183432 | A1 | 8/2005 | Cowans et al. | |
| 2006/0042285 | A1 | 3/2006 | Heberle et al. | |
| 2006/0064995 | A1 | 3/2006 | Rigal et al. | |
| 2006/0179874 | A1 | 8/2006 | Barger | |
| 2006/0191495 | A1 | 8/2006 | Sun | |
| 2006/0213210 | A1 | 9/2006 | Tomlinson et al. | |
| 2007/0000274 | A1 | 1/2007 | Li | |
| 2007/0068178 | A1 | 3/2007 | Honma et al. | |
| 2008/0104986 | A1 | 5/2008 | Gordon et al. | |
| 2008/0236185 | A1 | 10/2008 | Choi et al. | |
| 2008/0245087 | A1 | 10/2008 | Orcutt | |
| 2009/0026281 | A1 | 1/2009 | McGreevy | |
| 2009/0049857 | A1 | 2/2009 | Murakami et al. | |
| 2009/0120110 | A1 | 5/2009 | Grabon et al. | |
| 2009/0248212 | A1 | 10/2009 | Cowans et al. | |
| 2010/0000709 | A1 | 1/2010 | Chang | |
| 2010/0050675 | A1 | 3/2010 | Kameyama et al. | |
| 2010/0083950 | A1 | 4/2010 | Bloxam | |
| 2010/0209084 | A1 | 8/2010 | Nelson et al. | |
| 2011/0120168 | A1 | 5/2011 | Choi et al. | |
| 2011/0214437 | A1 | 9/2011 | Jeong et al. | |
| 2011/0259025 | A1 | 10/2011 | Noh et al. | |
| 2012/0042678 | A1 | 2/2012 | Park et al. | |
| 2012/0060521 | A1 | 3/2012 | Roetker et al. | |
| 2012/0102991 | A1 | 5/2012 | Lee et al. | |
| 2012/0180508 | A1 | 7/2012 | Endoh et al. | |
| 2012/0312045 | A1 | 12/2012 | Kim | |
| 2013/0104574 | A1 | 5/2013 | Dempsey et al. | |
| 2013/0167559 | A1 | 7/2013 | Kim et al. | |
| 2013/0312443 | A1* | 11/2013 | Tamaki | F25B 49/022 62/228.1 |
| 2014/0116072 | A1 | 5/2014 | Kim et al. | |
| 2014/0174117 | A1 | 6/2014 | Aoyagi et al. | |
| 2014/0230477 | A1 | 8/2014 | Furui et al. | |
| 2014/0260358 | A1 | 9/2014 | Leete et al. | |
| 2014/0260392 | A1 | 9/2014 | Hawkins et al. | |
| 2015/0040841 | A1 | 2/2015 | Leman et al. | |
| 2016/0040895 | A1 | 2/2016 | Wong | |
| 2016/0131402 | A1 | 5/2016 | Kim et al. | |
| 2017/0086334 | A1 | 3/2017 | Riddle | |
| 2017/0234576 | A1 | 8/2017 | Kawagoe et al. | |
| 2018/0051894 | A1 | 2/2018 | Yoshida et al. | |
| 2018/0120011 | A1* | 5/2018 | Goldman | F25B 13/00 |
| 2019/0063792 | A1 | 2/2019 | Kim et al. | |
| 2019/0309989 | A1 | 10/2019 | Chikami et al. | |
| 2019/0309995 | A1 | 10/2019 | Chikami et al. | |
| 2020/0149785 | A1* | 5/2020 | Kojima | F25B 41/24 |
| 2020/0278138 | A1 | 9/2020 | Huang et al. | |
| 2022/0163241 | A1 | 5/2022 | Kim et al. | |

FOREIGN PATENT DOCUMENTS

| | | | |
|---|---|---|---|
| CN | 200972229 | Y | 11/2007 |
| CN | 101614451 | A | 12/2009 |
| DE | 10058273 | A1 | 5/2002 |
| EP | 0138568 | A2 | 4/1985 |
| EP | 0151493 | A2 | 8/1985 |
| EP | 0240441 | A2 | 10/1987 |
| EP | 2103884 | A1 | 9/2009 |
| EP | 2360439 | A1 | 8/2011 |
| EP | 2489972 | A1 | 8/2012 |
| EP | 2538145 | A2 | 12/2012 |
| GB | 2537453 | A | 10/2016 |
| JP | H10288420 | A | 10/1998 |
| JP | H11270920 | A | 10/1999 |
| JP | 2011094931 | A | 5/2011 |
| JP | 5121908 | B2 | 1/2013 |
| JP | 2017198414 | A | 11/2017 |
| WO | 1990002300 | A1 | 3/1990 |
| WO | 2003036178 | A1 | 5/2003 |
| WO | 2006039580 | A1 | 4/2006 |
| WO | 2006128263 | A1 | 12/2006 |
| WO | 2006128264 | A1 | 12/2006 |
| WO | 2007146050 | A2 | 12/2007 |
| WO | 2010093516 | A2 | 8/2010 |
| WO | 2011015731 | A | 2/2011 |
| WO | 2012041225 | A1 | 4/2012 |
| WO | 2012/164608 | A1 | 12/2012 |
| WO | 2013061473 | A1 | 5/2013 |
| WO | 2019178117 | A1 | 9/2019 |

OTHER PUBLICATIONS

PCT, "International Search Report & Written Opinion" Application No. PCT/US2014/026894, dated Jul. 15, 2014.

(56) References Cited

OTHER PUBLICATIONS

EPO, "Extended European Search Report" Application No. 14773958.5, dated Apr. 10, 2017.
CNIPO, "First Office Action" Application No. 201480024058.8, dated Jan. 17, 2017.
AUIPO, "Second Examination Report" Application No. 2014243719, dated Mar. 17, 2017.
AUIPO, "Pre-Examination Processing Notice" Application No. 2014243719, dated Feb. 15, 2016.
CAIPO, "Examiner's Requisition" Application No. 2906662, dated Jun. 28, 2017.
CAIPO, "Office Action" Application No. 2906662, dated Aug. 23, 2016.
Rheem, "Integrated Air & Water System" Form No. S11-945, dated Jan. 2012, 60 pages.
International Search Report and Written Opinion for PCT Application No. PCT/US2021/040781 mailed Oct. 14, 2021.
"LG Hydro Kit," webpage https://lghvac.com/hydrokit/, retrieved from Internet on Oct. 25, 2023.
"Hot Water Solution (Hydro Kit)," webpage https://www.lg.com/global/business/hot-water-solution-hydro-kit/, retrieved from Internet on Oct. 25, 2023.
EPO, "Examination Report," Application No. 19177498.3, dated Nov. 17, 2022.
"Mitsubishi Electric VRF R2 Heat Recovery System," webpage https://www.youtube.com/watch?v=9HAzk2s7sYw, published on YouTube on Internet, Jan. 13, 2016.
"Mitsubishi Electric—City Multi R2 Series," webpage https://www.youtube.com/watch?v=-_2Xp5xDXYM, published on YouTube on Internet, Jan. 28, 2011.
"HVAC Multi-Split Variable Refrigerant Flow (VRF) Systems," webpage https://pdhonline.com/courses/m394/m394content.pdf, by A. Bhatia, 2020, 25 pps.
EPO, "Supplementary European Search Report" Application No. 21843395.1, dated Jul. 23, 2024, 10 pages.

* cited by examiner

INTEGRATED SPACE CONDITIONING AND WATER HEATING/COOLING SYSTEMS AND METHODS THERETO

FIELD OF THE DISCLOSURE

The present invention relates generally to an integrated space conditioning and water heating and cooling variable refrigerant flow system.

BACKGROUND

Variable refrigerant flow (VRF) systems, sometimes referred to as variable refrigerant volume (VRV) systems, can vary the flow of refrigerant to indoor units based on demand for heating or cooling. A conventional VRF conditioning system can include one or more outdoor units and multiple heat exchanger terminals (e.g., heat exchanger terminals corresponding to different rooms in a building). The heat exchanger terminals are configured to heat and/or cool air within an interior space. The VRF conditioning system can provide multiple benefits, including energy savings. A primary benefit of the VRF conditioning system can be the ability to provide independent and/or simultaneous heating and/or cooling to different rooms or spaces in a building. Additionally, the VRF conditioning system can appropriately control the supply of refrigerant to each heat exchanger terminals, allowing for precise temperature regulation. Thus, VRF conditioning systems can provide improved comfort for individuals at multiple locations within the building. Further, VRF conditioning systems can achieve independent climate control at multiple locations with a single system rather than requiring multiple separate Heating, Ventilation and Air Conditioning (HVAC) systems. Thus, VRF conditioning systems can provide increased cost-savings, as compared to traditional HVAC systems, as a result of more efficient heating and cooling.

Existing VRF conditioning systems, however, are typically limited to conditioning room temperatures (i.e., air) and are not able to control the temperature of liquids. Thus, a user wishing to heat or cool water in addition to conditioning room temperatures is required to install multiple dedicated systems: at least one system for heating or cooling room temperatures (i.e., air) and at least one system for heating or cooling liquids (e.g., water).

SUMMARY

These and other problems can be addressed by the technologies described herein. Examples of the present disclosure relate generally to a variable refrigerant flow (VRF) conditioning system configured to provide simultaneous heating or cooling of interior air and heating or cooling of liquid.

The disclosed technology can include a VRF conditioning system including one or more outdoor units and a VRF network extending between the outdoor unit and a plurality of terminals. The VRF condition system can, for example, include a single outdoor unit. The single outdoor unit can have a compressor, a condenser coil, and a fan. The plurality of terminals can include a first terminal having an evaporator and configured to condition air of a room. The second terminal can be configured to heat or cool liquid. The second terminal can include a liquid heating device.

The VRF conditioning system can be configured to simultaneously provide an air-heating effect via the first terminal and a liquid-heating via the second terminal. The VRF conditioning system can be configured to simultaneously provide an air-heating effect via the first terminal and a liquid-cooling effect via the second terminal. The VRF conditioning system can be configured to simultaneously provide an air-cooling effect via the first terminal and a liquid-heating effect via the second terminal. The VRF conditioning system can be configured to simultaneously provide an air-cooling effect via the first terminal and a liquid-cooling effect via the second terminal.

The VRF conditioning system can further include a main controller in communication with the outdoor unit. The main controller can be configured to receive a signal from a first controller associated with the first terminal and a second controller associated with the second terminal, the signal indicating a demand for heating or cooling. The main controller can be configured to output instructions to the outdoor unit to vary a supply of refrigerant based on the demand.

The disclosed technology can also include a VRF conditioning system including a plurality of outdoor units, a plurality of terminals, and a single refrigerant network in communication with each of the plurality of outdoor units and each of the plurality of terminals. Each outdoor unit can include a compressor, a condenser coil, and a fan. The plurality of terminals can include a first terminal having an evaporator and configured to condition air of a room. The second terminal can be configured to heat or cool liquid. The second terminal can include a fluid heating device.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
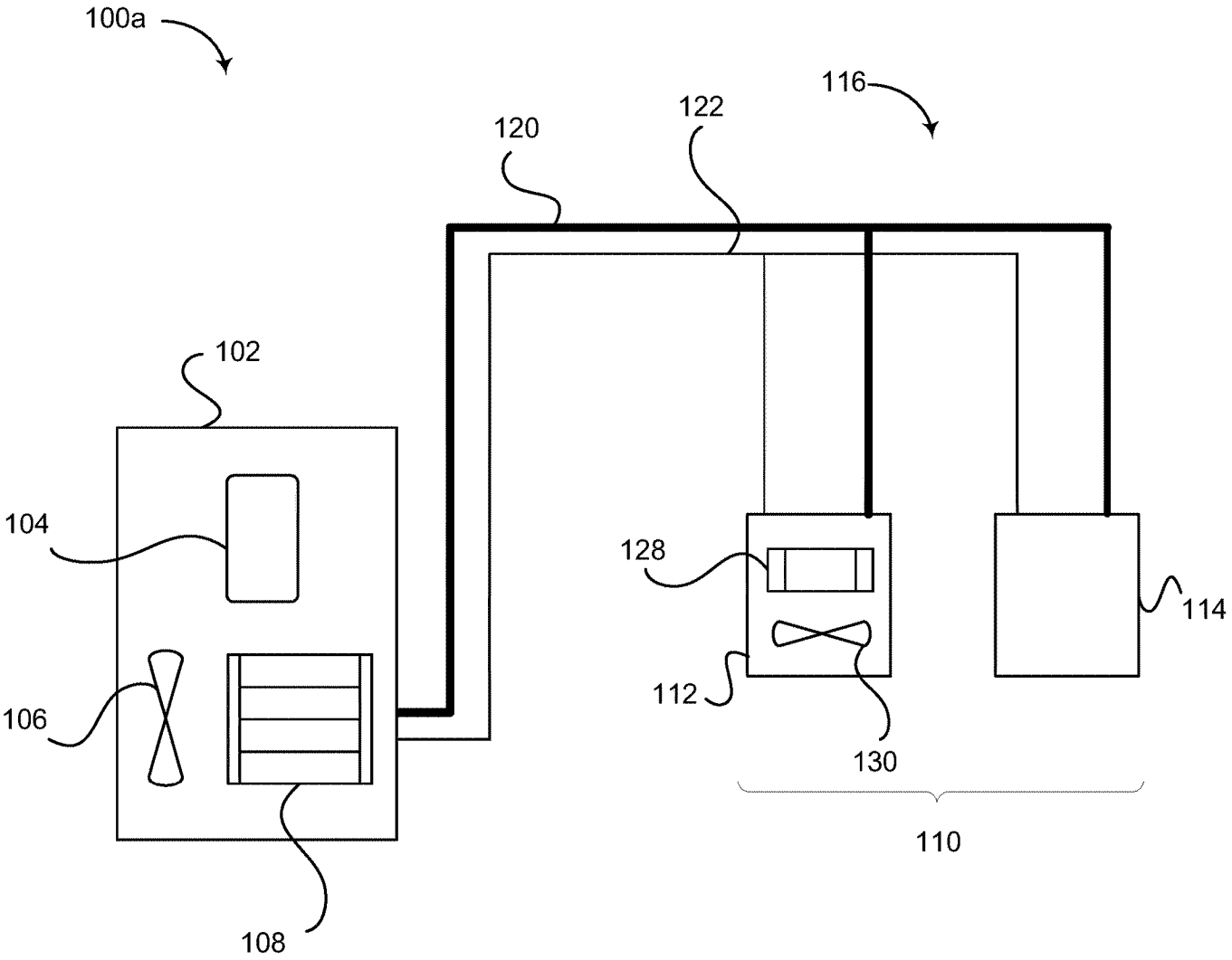
FIG. 1A illustrates an example two-pipe VRF conditioning system, in accordance with the disclosed technology.

The disclosed technology relates to a variable refrigerant flow (VRF) conditioning system including one or more outdoor units and a VRF network extending between the outdoor unit(s) and a plurality of heat exchanger terminals. As will be described more fully below, the VRF conditioning system can include any number of outdoor units. For example, the VRF conditioning system can include as few as a single outdoor unit. As additional examples, the VRF conditioning system can include two, three, four, ten, or more outdoor units. The plurality of terminals can include a first terminal configured to condition air of a room and a second terminal configured to heat or cool a liquid (e.g. water). The second terminal can be a liquid heating device (e.g. a water heating device), for example. As described more fully below, the VRF system can provide independent and/or simultaneous heating or cooling of air in different rooms or zones within a building, as well as heating or cooling of water or another liquid. While aspects of the disclosed technology are described herein as heating or cooling water, it is to be understood that the disclosed technology is not so limited, as the disclosed technology can heat or cool or refrigerate other liquids.

The VRF system can further include a main controller in electrical communication with the outdoor unit and can include a controller associated with each terminal. In response to receiving an indication of demand for heating or cooling at a given terminal, the main controller can output instructions to the outdoor unit to vary the supply of refrigerant to one or more terminals. For example, the main controller can output instructions for the outdoor unit to provide to a corresponding terminal only the necessary volume of refrigerant required to meet the heating or cooling demand of the terminal. By varying the supply of refrigerant based on the demand of a terminal, efficient and precise temperature regulation of air and liquid can be provided, resulting in energy savings and/or operational cost savings.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

Schematic diagrams of certain example systems are shown in the drawings, and these schematics illustrate multiple refrigerant lines (e.g., supply line, return line, liquid line, vapor line) as detailed herein. In some instances, a refrigerant line of one type is shown as intersecting or overlapping a refrigerant line of another type. It is to be understood that the drawings are so shown merely for clarity of the drawings, and such overlapping or intersection is not indicative of different types of refrigerant lines being in direct fluid communication.

Referring now to the drawings, FIGS. 1A through 2B illustrate example VRF conditioning systems 100, 200. As shown and as discussed more fully below, the disclosed technology can be used in conjunction with a two-pipe VRF system (e.g., VRF systems 100*a*, 100*b* (collectively referenced as VRF system 100)) and a three-pipe VRF system (e.g., VRF systems 200*a*, 200*b* (collectively referenced as VRF system 200)). Each VRF conditioning system 100, 200 can include an outdoor unit 102 and a plurality of terminals 110. While the disclosed technology can include any number of outdoor units 102, the remaining disclosure references all outdoor units 102 as a singular outdoor unit 102 for conciseness of discussion. The outdoor unit(s) 102 and the terminals 110 can be in fluid connection via a variable refrigerant network 116, which can include any combination of pipes, tubes, hoses, and the like. The variable refrigerant network 116 can transport refrigerant from the outdoor unit 102 to each of the terminals 110 based on a demand for heating or cooling. The VRF conditioning systems 100, 200 can be configured to condition (e.g. heat and/or cool) air of a room or rooms and heat or cool liquid (e.g. water).

The outdoor unit 102 can be positioned or located outside or external to a commercial building, residential building, or any other structure. The outdoor unit 102 can be positioned at any location where the outdoor unit 102 can receive air from the environment. For example, the outdoor unit 102 can be positioned on the ground proximate to the building or structure. As another example, the outdoor 102 unit can be positioned on the rooftop of the building or structure.

The outdoor unit 102 can include a compressor 104, a fan 106, and a condenser coil 108. The compressor 104 can be disposed proximate to the condenser coil 108. The compressor 104 and the condenser coil 108 can be in fluid communication via refrigerant network. The compressor 104 can be in fluid communication with each of the terminals 110 via refrigerant network. The compressor 104 can be configured to operate at variable speeds (e.g., the compressor 104 can be inverter-driven). The compressor 104 can vary speed of the motor by changing the power supply to the compressor 104. When the motor of the compressor 104 changes speed, the supply of refrigerant and/or flow rate of refrigerant delivered to each of the terminals 110 can change. By way of example, if the motor of the compressor 104 increases speed, the supply and/or flow rate of refrigerant delivered to the terminals can be increased. Modulating the supply and/or flow rate of refrigerant delivered to each of the terminals 110 can help provide precise regulation of temperature.

The fan 106 can be positioned proximate the condenser coil 108. The fan 106 can draw ambient air from the environment across the condenser coil 108. When one or more terminals indicate a demand for cooling, vapor refrigerant flowing through the condenser coil 108 can lose heat to the ambient air, causing the refrigerant to decrease in temperature and transition from a vapor refrigerant to a liquid refrigerant. The liquid refrigerant can then be directed to the one or more terminals indicating a demand for cooling. Alternatively, when one or more terminals indicate a demand for heating, the condenser coil 108 can operate as an evaporator such that the liquid refrigerant flowing through the condenser coil 108 can acquire heat from the ambient air, resulting in the liquid refrigerant transitioning to vapor refrigerant. The vapor refrigerant can then be directed to the one or more terminals indicating a demand for heating. If multiple terminals 110 simultaneously require heating at the same time, the compressor 104 can operate at a higher speed to meet the heating demand of each terminal. If, however, a single terminal 110 requires heat, the compressor 104 can operate at a lower speed to provide the necessary heating for the single terminal 110. The fan 106 can facilitate transfer of heat energy from the refrigerant into the outdoor environment. The fan 106 can be configured to operate at variable speeds. The fan 106 can vary speed in response to demand of the terminals 110 such that the supply of refrigerant and flow rate of refrigerant delivered to each of the terminals 110 can be modulated.

The plurality of terminals 110 can be disposed within an interior of a commercial or residential building or any structure. Each of the terminals 110 can include a heat exchanger. One or more of the terminals 110 can be configured to condition (e.g. heat and/or cool) air within an interior room or area. The terminal(s) configured to condition air can be or include an apparatus capable of changing the temperature of air being delivered to a conditioned space and can have an associated refrigerant circuit. By way of example, the terminal can include or be embodied in a cassette indoor unit, a ceiling suspending indoor unit, a wall mounted indoor unit, a floor exposed indoor unit, a floor concealed indoor unit, a ducted indoor unit, and a ductless indoor unit.

One or more of the terminals 110 can be configured to heat or cool liquid for any application, including domestic and sanitary applications. When the terminal 110 is configured to heat or cool liquid, the terminal can be a liquid heating device. The terminal 110 can be a heat pump water heater. Alternatively or in addition to, the terminal 110 can be a traditional tank based or tankless, fuel-fired or electric, water heater. When the terminal 110 is a traditional tank based or tankless, fuel-fired or electric, water heater, the traditional water heater can be in thermal communication with refrigerant such that the refrigerant can heat or cool the water. The terminal 110 can be configured to heat and cool a pool. The terminal 110 can be or can comprise a chilled beam. If the terminal 110 is or comprises a chilled beam, it can be helpful to maintain the indoor temperature to avoid condensation, which can improve the effectiveness of the chilled beam application.

The VRF conditioning systems 100, 200 can include any number of terminals 110. Any number of terminals 110 can be configured to condition air and any number of terminals 110 can be configured to heat or cool liquid. Each of the terminals 110 can operate independently of one another, such that some, none, or all of the terminals 110 can be in operation simultaneously. In this configuration, it is not necessary for a terminal 110 configured to condition air to be operating in order for a terminal 110 configured to heat or cool liquid to be operating. By way of example, the VRF conditioning systems 100, 200 can be configured such that one terminal 110 can be operating in an air heating mode and providing heated air, while another terminal 110 can be operating in an air cooling mode, while yet another terminal 110 can be operating in a liquid cooling mode or a liquid heating mode, and yet another terminal 100 configured to condition air can be in an inactive or off mode such that the terminal is not heating or cooling air.

A variable refrigerant network 116 can direct a variable supply of refrigerant from the outdoor unit to each terminal of the plurality of terminals 110 and direct a return supply of refrigerant back to the outdoor unit 102. The variable refrigerant flow network 116 can include conduits sized to accommodate energy efficiency standards and code requirements. The conduits can include insulation. The thickness and/or type of the insulation can vary depending on the codes, regulations, environmental temperature, operating temperatures of the refrigerant flowing through the conduits, and the like.

One or more expansion valves, including electronic expansion valves, can be disposed within the variable refrigerant network 116 between the condenser coil 108 and each terminal 110. The supply of refrigerant and/or flow rate of refrigerant being directed into each terminal 110 can be controlled via the expansion valve(s), thereby providing an additional method to control the supply of refrigerant and flow rate of refrigerant based on the demands of each terminal.

The refrigerant cycled between the outdoor unit and the terminals 110 can be refrigerant used in HVAC applications. For example, the refrigerant can include chlorofluorocarbons hydrochlorofluorocarbons, hydrofluorocarbons, and the like.

Figure 1B:
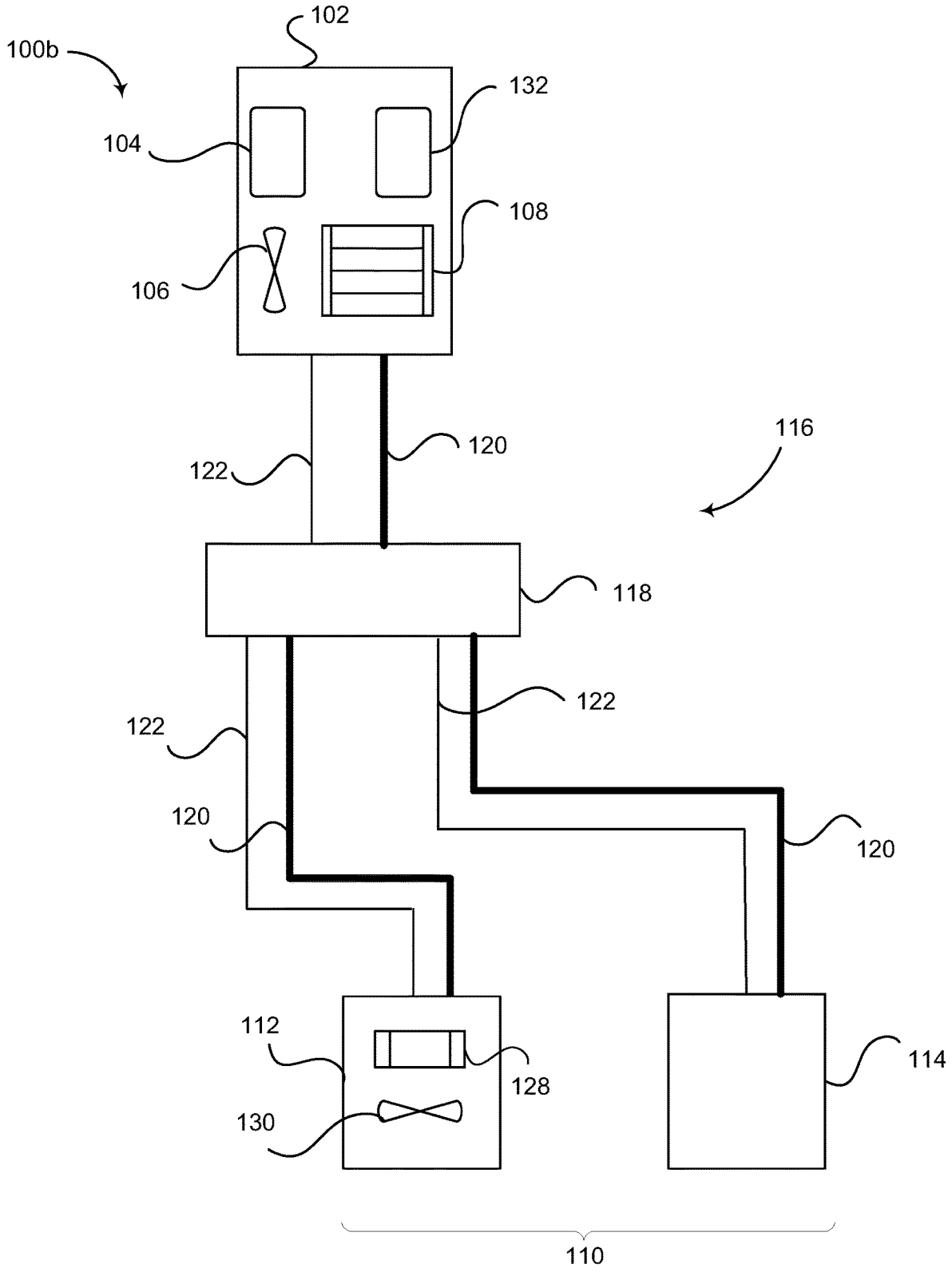
FIG. 1B illustrates an example two-pipe VRF conditioning system configured to provide simultaneous heating and cooling, in accordance with the disclosed technology.

FIGS. 1A and 1B illustrate an example two-pipe VRF conditioning system 100. FIG. 1A illustrates a two-pipe VRF conditioning system 100*a* configured to provide heating or cooling at a plurality of terminals 110. The VRF conditioning system 100*a* can include a single outdoor unit 102 in fluid communication with an air terminal 112 (e.g., a first terminal) and a liquid terminal 114 (e.g., a second terminal) via a variable refrigerant network 116. The air terminal 112 can be configured to condition air of an interior room or space and the liquid terminal 114 can be configured to heat or cool liquid.

The variable refrigerant network 116 can include a return refrigerant conduit 120 and a supply refrigerant conduit 122. The supply refrigerant conduit 122 can transfer liquid refrigerant or vapor refrigerant to the air terminal 112 and the liquid terminal 114. The return refrigerant conduit 120 can transfer liquid refrigerant or vapor refrigerant to the outdoor unit 102. In this configuration, the air terminal 112 and the liquid terminal 114 can operate in a heating mode or a cooling mode, however, the air terminal 112 and the liquid terminal 114 cannot provide simultaneous heating and cooling.

The variable refrigerant network 116 can transfer a variable supply of refrigerant and/or variable flow rate of refrigerant to the air terminal 112 and the liquid terminal 114 in response to a demand of the air terminal 112 and the liquid terminal 114. By modulating the supply of refrigerant and/or flow rate of refrigerant being delivered to air terminal 112 and the liquid terminal 114, only the necessary supply of refrigerant that is required for sufficient heating and/or cooling can be delivered.

In response to a demand for heated air via the air terminal 112 and heater water via the liquid terminal 114, the air terminal 112 and the liquid terminal 114 can operate in a heating mode. In the heating mode, vapor refrigerant can be directed from the outdoor unit 102 to the air terminal 112 and the liquid terminal 114 via the supply refrigerant conduit 122. The supply and flow rate of hot vapor refrigerant delivered to the air terminal 112 and the liquid terminal 114 can be based on the demand (i.e., the amount of heat required to satisfy the demand).

In the heating mode, the evaporator 128 of the air terminal 112 can operate as a condenser, such that the evaporator 128 can receive the hot vapor refrigerant. As the hot vapor refrigerant flows through the evaporator 128, the vapor refrigerant can condense to a liquid refrigerant. During this phase change, heat can be dissipated. The dissipated heat can be transferred to the surrounding air within the interior room or zone via the fan 130, thereby heating the air in the room or zone. The liquid refrigerant can be directed back to the outdoor unit 102 via the return refrigerant conduit 120 such that the cycle can repeat.

In the heating mode, the liquid terminal 114 can receive hot vapor refrigerant via the supply refrigerant conduit 122. The supply refrigerant conduit 122 can be in communication with the liquid terminal 114. Optionally, the supply refrigerant conduit 122 can be coiled or wrapped around a tank of a liquid heating device. The hot vapor refrigerant flowing through the supply refrigerant conduit 122 can be warmer than the water within the liquid heating device. The water within the liquid heating device can draw heat from the hot vapor refrigerant, resulting in the water being heated. The heated water can be outputted from the liquid heating device for any application, including domestic or sanitary. As the water in the liquid heating device draws heat from the hot vapor refrigerant, the vapor refrigerant can transition to liquid refrigerant. The liquid refrigerant can be directed back to the outdoor unit 102 via the return refrigerant conduit 120 such that the cycle can repeat. The liquid terminal 114 can be in thermal communication with the refrigerant flowing through the supply refrigerant conduit 122 via different types of heat exchangers such as a brazed plate heat exchanger or a tube-in-tube heat exchanger such that the water within the liquid terminal 114 can acquire heat from the vapor refrigerant flowing through the heat exchangers. The liquid terminal 114 can include a supplemental heat source such that the liquid terminal 114 can heat water using refrigerant and/or the supplemental heat source.

In response to a demand for cooled air via the air terminal 112 and cooled liquid via the liquid terminal 114, the air terminal 112 and the liquid terminal 114 can operate in a cooling mode. In the cooling mode, liquid refrigerant can be directed from the outdoor unit 102 to the air terminal 112 and the liquid terminal 114 via the supply refrigerant conduit 122. In the cooling mode, the evaporator 128 of the air terminal 112 can receive the liquid refrigerant via the supply refrigerant conduit 122. A fan 130 disposed within the air terminal 112 can draw ambient air from the interior room across the evaporator 128. The ambient air from the interior room can be warmer than the liquid refrigerant flowing through the evaporator 128. The liquid refrigerant can remove the heat from the ambient air, causing the liquid refrigerant to transition to a vapor refrigerant. As the heat from the ambient air is removed, the interior air can become cooler, resulting in an air-cooling effect. The vapor refrigerant can be directed back to the outdoor unit 102 via the return refrigerant conduit 120 such that the cycle can repeat.

In the cooling mode, the liquid terminal 114 can receive the liquid refrigerant via the supply refrigerant conduit 122. The supply refrigerant conduit 122 can be in communication with the liquid terminal 114. Optionally, the supply refrigerant conduit 122 can be coiled or wrapped around a water storage tank of the liquid terminal 114. The water within the water storage tank can be warmer than the liquid refrigerant flowing through the supply refrigerant conduit 122. The liquid refrigerant can draw heat from the warmer water, resulting in the water within the fluid holding device being cooled. The cooled water can be outputted from the liquid terminal 114 for any application, including domestic and sanitary. As the liquid refrigerant draws heat from the warmer water stored in the tank, the liquid refrigerant can transition to gas refrigerant. The gas refrigerant can be directed back to the outdoor unit 102 via the return refrigerant conduit 120 such that the cycle can repeat.

If the air terminal 112 and the liquid terminal 114 indicate demands for different modes (e.g. one terminal indicates a demand for heating while the other terminal indicates a demand for cooling), the outdoor unit 102 can switch between operating in a cooling mode and operating in a heating mode such that the demand of the air terminal 112 and demand of the liquid terminal 114 can be met successively. By way of example, in response to a demand for cooled air via the air terminal 112 and heated water via the liquid terminal 114, the outdoor unit 102 can first direct liquid refrigerant to the air terminal 112 and subsequently direct vapor refrigerant to the liquid terminal 114. Alternatively, the outdoor unit 102 can first direct vapor refrigerant to the liquid terminal 114 and subsequently liquid refrigerant to the air terminal 112. Similarly, in response to a demand for heated air via the air terminal 112 and cooled water via the liquid terminal 114, the outdoor unit 102 can first direct vapor refrigerant to the air terminal 112 and subsequently direct liquid refrigerant to the liquid terminal 114. Alternatively, the outdoor unit 102 can first direct liquid refrigerant to the liquid terminal 114 and subsequently direct vapor refrigerant to the air terminal 112.

The VRF conditioning system 100*a* as illustrated in FIG. 1A can be used in open floor plan areas, including retail stores, open offices, or any other area where it can be beneficial to have cooling or heating of interior air and cooling or heating of liquid during the same operational period, however, it is not necessary to providing heating and cooling of air or liquid simultaneously.

FIG. 1B illustrates an example two-pipe VRF conditioning system 100*b* including a branch circuit controller 118. As will be appreciated, the term "branch circuit controller" can sometimes be used interchangeable with the term "branch selector." For conciseness, the disclosure uses the term "branch circuit controller." The VRF conditioning system 100*b* can include the outdoor unit 102, the air terminal 112 and the liquid terminal 114. The variable refrigerant network 116 can direct a supply of refrigerant from the outdoor unit 102 to the air terminal 112 and the liquid terminal 114 based on the heating or cooling demand of the air terminal 112 and the liquid terminal 114. The variable refrigerant network 116 can include a return refrigerant conduit 120 in fluid communication with the outdoor unit 102 and the air terminal 112 and liquid terminal 114. The return refrigerant conduit 120 can be configured to direct refrigerant from the air terminal 112 and the liquid terminal 114 back to the outdoor unit 102 such that the refrigerant flow cycle can repeat.

The variable refrigerant network 116 can include a supply refrigerant conduit 122 in fluid communication with the outdoor unit 102 and the branch circuit controller 118. The supply refrigerant conduit 122 can transfer a gas/liquid refrigerant mix from the outdoor unit 102 to the branch circuit controller 118.

A refrigerant diverter 132 can be disposed within the outdoor unit 102 in order to provide simultaneous heating and cooling at the terminals 110. Upon a demand for heating for at least one of the terminals 110, the refrigerant diverter 132 can direct vapor refrigerant from the compressor 104 to the air terminal 112 and/or the liquid terminal 114 via the variable refrigerant conduit 120. In this configuration, the vapor refrigerant can bypass the condenser 108 such that the vapor refrigerant is not condensed to liquid refrigerant in the condenser 108 but instead condenses within the air terminal 112 and/or the liquid terminal 114 to provide simultaneous heating and cooling between the air terminal 112 and the liquid terminal 114.

The branch circuit controller 118 can be configured to separate the gas/liquid refrigerant mix into vapor refrigerant and liquid refrigerant such that the VRF conditioning system 100*b* can provide simultaneous heating at the air terminal 112 and cooling at the liquid terminal 114 or vice versa. Depending on the demand of the air terminal 112 and the liquid terminal 114, the branch circuit controller 118 can direct either vapor refrigerant or liquid refrigerant to each terminal via the supply refrigerant conduit 122. By way of example, if the air terminal 112 indicates a demand for cooling air, the branch circuit controller 118 can direct liquid refrigerant to the air terminal 112 via the supply refrigerant conduit 122. If the liquid terminal 114 indicates a demand for heated water, the branch circuit controller 118 can direct vapor refrigerant to the liquid terminal 114 via the supply refrigerant conduit 122. In this configuration, the VRF conditioning system 100 can provide simultaneous cooling of air and heating of water.

The branch circuit controller 118 can allow the VRF conditioning system 100*b* to operate in a heat recovery mode. By way of example, when the VRF conditioning system 100*b* is operating in a heat recovery mode, extracted heat energy from a terminal 110 operating in a cooling mode can be directed to a terminal 110 indicating a demand for heating via the branch circuit controller 118 to provide an efficient use of heat energy.

Figure 2A:
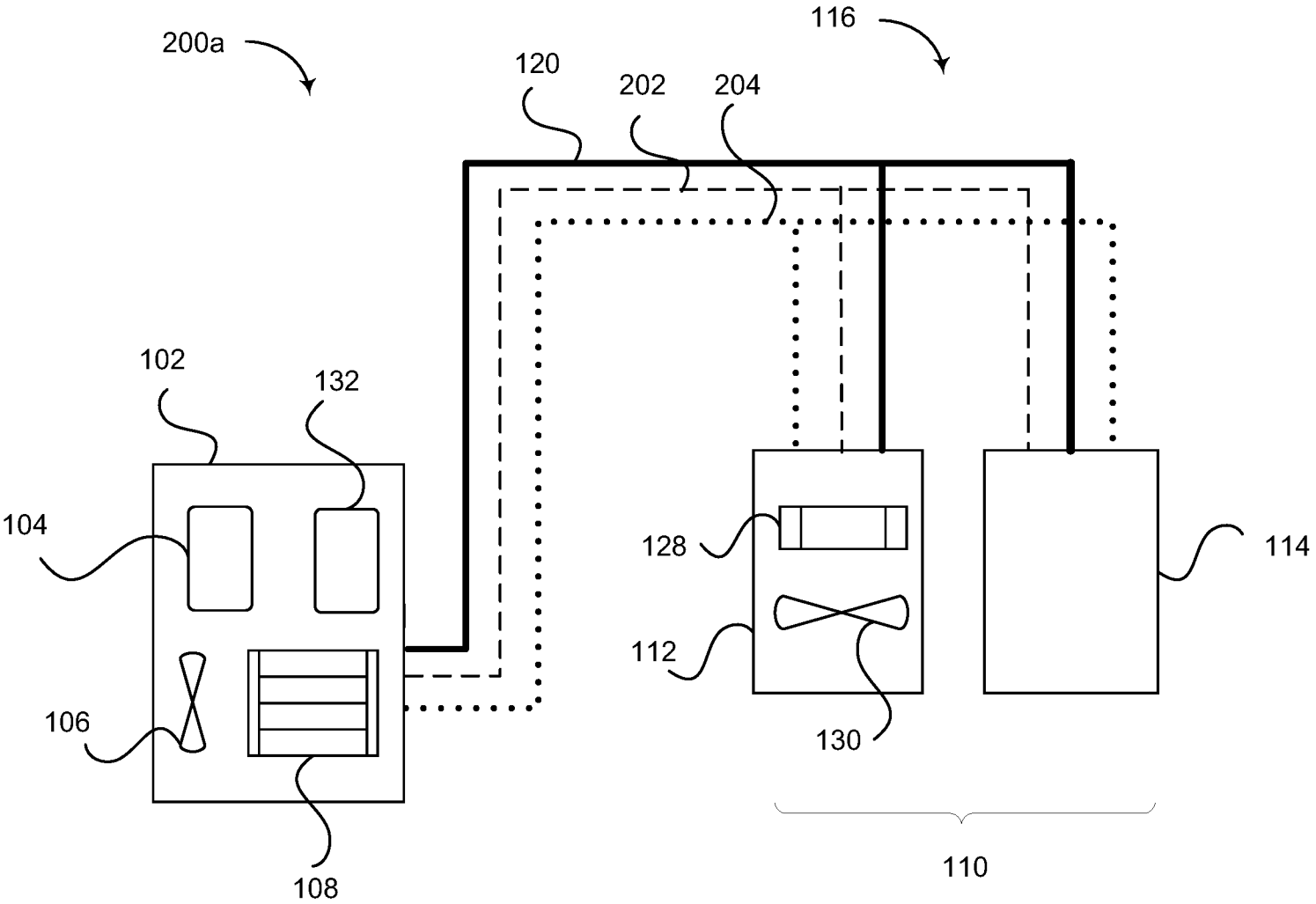
FIG. 2A illustrates an example three-pipe VRF conditioning system, in accordance with the disclosed technology.
Figure 2B:
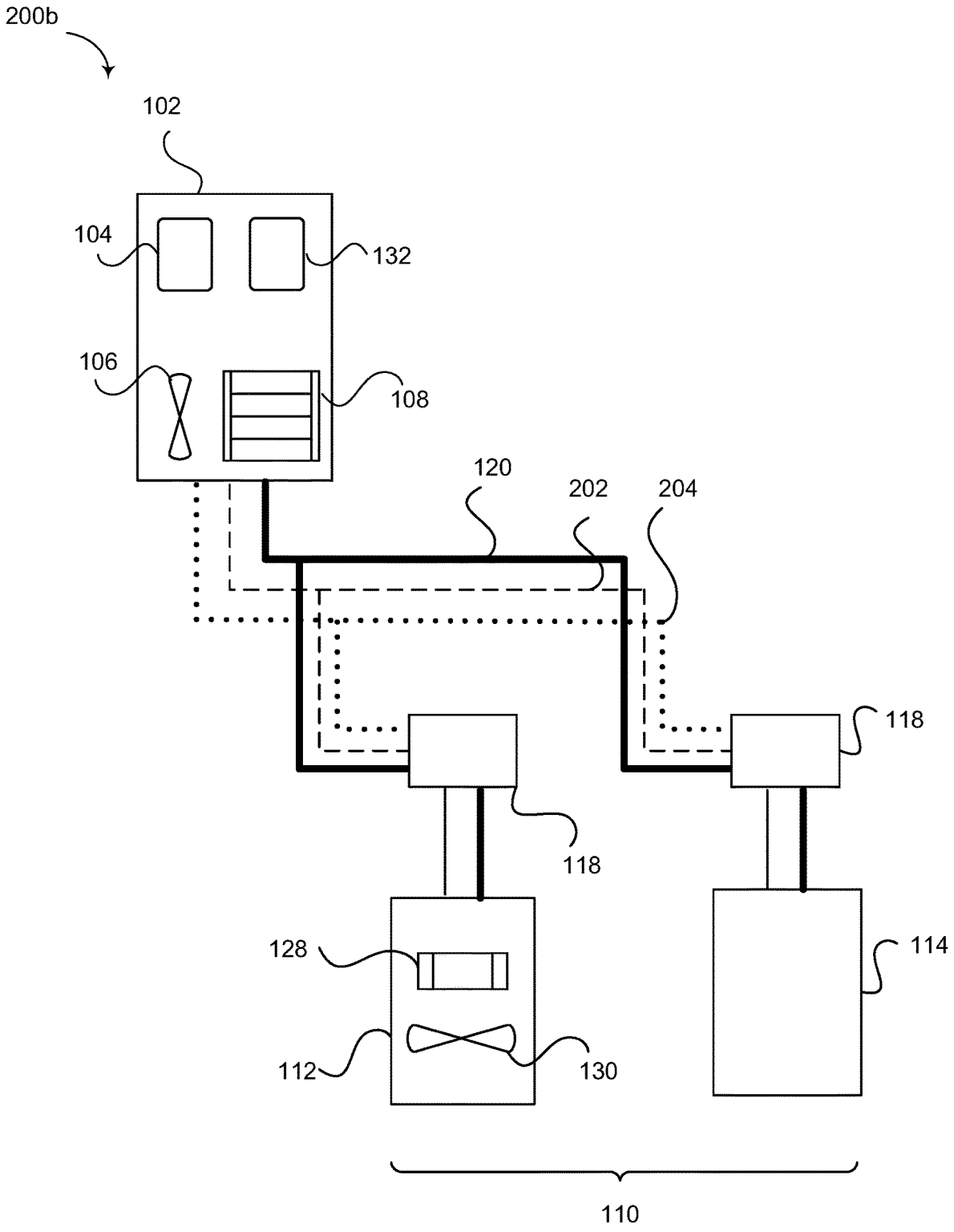
FIG. 2B illustrates an example three-pipe VRF conditioning system including a branch circuit controller, in accordance with the disclosed technology.

FIGS. 2A and 2B illustrate an example three-pipe VRF conditioning system 200*a*, 200*b*. The example three-pipe VRF conditioning system 200*a* can operate in heating and cooling modes simultaneously, such that any combination of heating and cooling of air of a room or area and heating and cooling of liquid can be provided.

FIG. 2A illustrates an example three-pipe VRF conditioning system 200*a*, 200*b* (collectively 200) including an outdoor unit 102 in fluid communication with an air terminal 112 and a liquid terminal 114 via a variable refrigerant path 116. The variable refrigerant network 116 can include a return refrigerant conduit 120, a liquid refrigerant conduit 202, and a vapor refrigerant conduit 204, each extending from the outdoor unit 102 to the air terminal 112 and the liquid terminal 114. Because the VRF conditioning system 200*a* can include separate conduits for directing vapor refrigerant and liquid refrigerant, the VRF conditioning system 200*a* can provide simultaneous heating or cooling of air and heating or cooling of liquid.

In response to a demand for heated air via the air terminal 112 and cooled water via the liquid terminal 114, vapor refrigerant can be directed from the outdoor unit 102 to the air terminal 112 via the vapor refrigerant conduit 204 and liquid refrigerant can be directed from the outdoor unit 102 to the liquid terminal 114 via the liquid refrigerant conduit 202. In response to a demand for cooled air and heated water, liquid refrigerant can be directed from the outdoor unit 102 to the air terminal 112 via the liquid refrigerant conduit 202 and vapor refrigerant can be directed from the outdoor unit 102 to the liquid terminal 114 via the vapor refrigerant conduit 204.

In response to a demand for heated air and heated water, vapor refrigerant can be directed from the outdoor unit 102 to the air terminal 112 and the liquid terminal 114 via the vapor refrigerant conduit 204. In response to a demand for cooled air and cooled water, liquid refrigerant can be directed from the outdoor unit 102 to the air terminal 112 and the liquid terminal 114 via the liquid refrigerant conduit 202.

The variable refrigerant network 116 can transfer a variable supply of refrigerant and/or flow rate of refrigerant to the air terminal 112 and the liquid terminal 114 in response to a demand of the air terminal 112 and the liquid terminal 114. By modulating the supply of refrigerant and flow rate of refrigerant being delivered to air terminal 112 and the liquid terminal 114, only the necessary supply of refrigerant need be delivered. The VRF conditioning system 100 can thus provide efficient and precise temperature regulation of both interior air and liquid.

The outdoor unit 102 can optionally include the refrigerant diverter 132. The refrigerant diverter 132 can direct vapor refrigerant from the compressor 104 to the air terminal 112 and/or the liquid terminal 114 via the vapor refrigerant conduit 204. In this configuration, the vapor refrigerant can bypass the condenser 108 such that the vapor refrigerant is not condensed to liquid refrigerant in the condenser 108 but instead condenses within the air terminal 112 and/or the liquid terminal 114 to provide simultaneous heating and cooling between the air terminal 112 and the liquid terminal 114.

FIG. 2B illustrates an example three-pipe VRF system 200*b* including the branch circuit controller 118. The VRF conditioning system 200*b* can include the outdoor unit 102 in fluid communication with the air terminal 112, and the liquid terminal 114 via the variable refrigerant network 116. The variable refrigerant network 116 can include the return refrigerant conduit 120, the liquid refrigerant conduit 202, and the vapor refrigerant conduit 204. The return refrigerant conduit 120, the liquid refrigerant conduit 202, and the vapor refrigerant conduit can extend from the outdoor unit 102 to one or more branch circuit controller 118.

The outdoor unit can include the refrigerant diverter 132. Upon a demand for heating for at least one of the terminals 110, the refrigerant divider 132 can direct vapor refrigerant from the compressor 104 to the air terminal 112 and/or the liquid terminal 114 via the vapor refrigerant conduit 208. In this configuration, the vapor refrigerant can bypass the condenser 108 such that the vapor refrigerant is not condensed to liquid refrigerant in the condenser 108 but instead condenses within the air terminal 112 and/or liquid terminal 114 to provide simultaneous heating and cooling between the air terminal 112 and the liquid terminal 114.

Each branch circuit controller 118 can be disposed within the variable refrigerant network 116 between the outdoor unit 102 and each terminal of the plurality of terminals 110, such that each terminal can be associated with a branch circuit controller 118. As illustrated in FIG. 2B, the branch circuit controller 118 can be disposed in the variable refrigerant network 116 between the outdoor unit 102 and the air terminal 112 and an additional, and separate branch circuit controller 118 can be disposed in the variable refrigerant network 116 between the outdoor unit 102 and the liquid terminal 114. The branch circuit controller 118 can be configured to direct either vapor refrigerant or liquid refrigerant to the air terminal 112 and the liquid terminal 114 depending on the demand of the air terminal 112 and the liquid terminal 114.

In response to a demand for heated air and heated water, the branch circuit controller 118 can direct vapor refrigerant to the air terminal 112 and the liquid terminal 114, respectively. In response to a demand for cooled air and cooled water, the branch circuit controller 118 can direct liquid refrigerant to the air terminal 112 and the liquid terminal 114, respectively. In response to a demand for heated air and cooled water, the branch circuit controller 118 can direct vapor refrigerant to the air terminal 112 and liquid refrigerant to the liquid terminal 114. In response to a demand for cooled air and heated water, the branch circuit controller 118 can direct liquid refrigerant to the air terminal 112 and vapor refrigerant to the liquid terminal 114. In response to no demand for heated or cooled air, the branch circuit controller 118 can prevent liquid refrigerant and gas refrigerant from flowing to the air terminal 112. In response to no demand for heated or cooled water, the branch circuit controller 118 can prevent liquid refrigerant and gas refrigerant from flowing to the liquid terminal 114.

The branch circuit controller 118 can allow the VRF conditioning system 200*b* to operate in a heat recovery mode. In the heat recovery mode, heat dissipated or rejected from terminals 110 operating in a cooling mode can be utilized by terminals 110 operating in a heating mode, resulting in improved system efficiency.

The VRF conditioning system 100*b*, 200 illustrated in FIGS. 1B through 2B can provide simultaneous heating or cooling of interior air of multiple rooms or zones within a home or building while also providing heating or cooling of liquid. The VRF conditioning system 100*b*, 200 can be beneficial for homes or buildings having multiple rooms or zones, where some of the rooms or zones need heating and some of the rooms or zones need cooling during the same time period. The VRF conditioning system 100*b*, 200 can be beneficial for homes or buildings having multiple rooms or zones, where some of the rooms or zones need heating and some of the rooms or zones need cooling, and where the home or building includes devices or systems needing heating or cooling of liquid, during the same time period.

Figure 3:
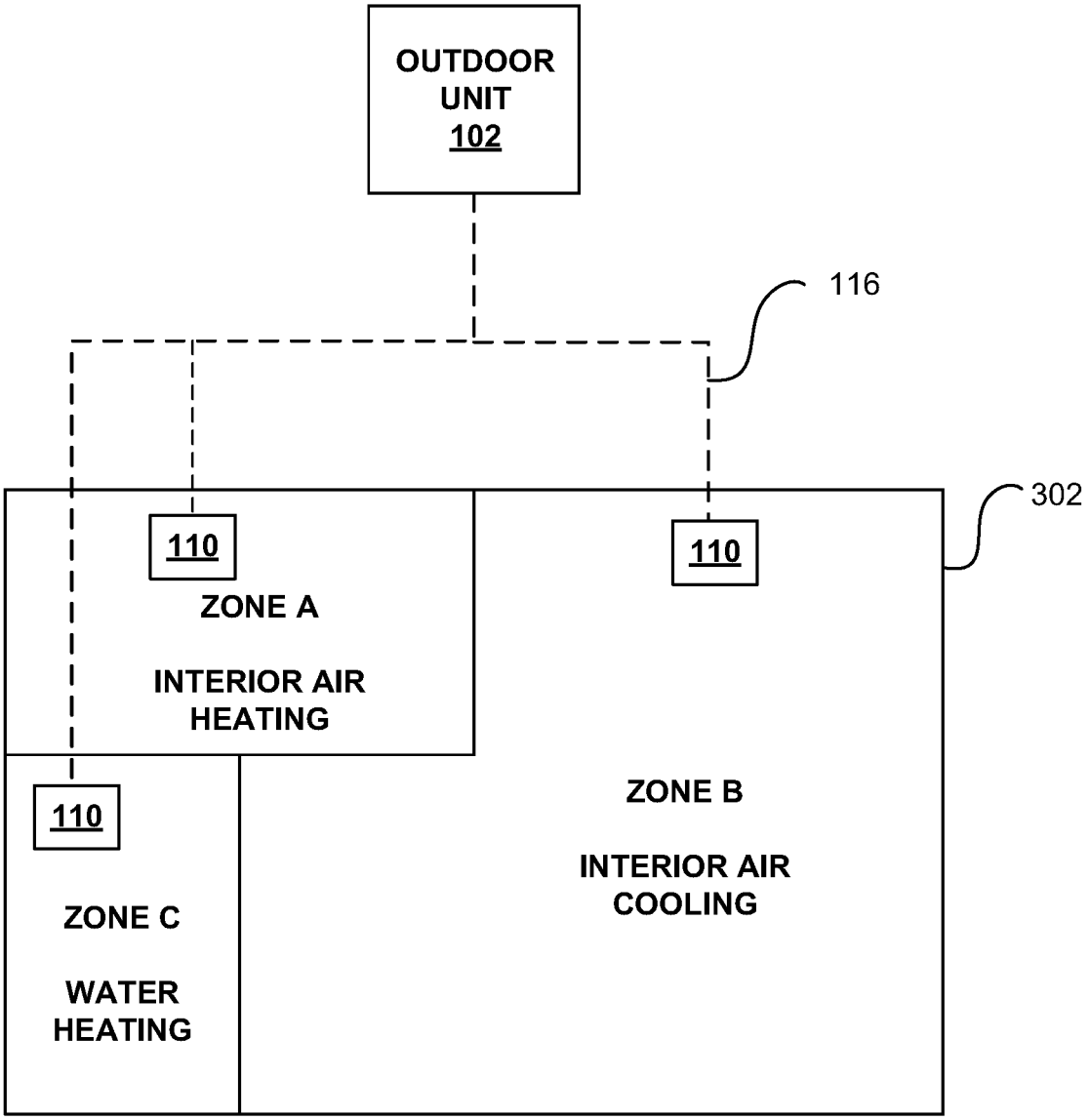
FIG. 3 illustrates a schematic diagram of an example VRF conditioning system configured to condition interior air and heat or cool liquid, in accordance with the disclosed technology.

FIG. 3 illustrates an example schematic diagram of the VRF conditioning system 100*b*, 200 configured to simultaneously condition air of one or more zones and heat or cool liquid. In FIG. 3, an outdoor unit 102 is in fluid communication with a plurality of terminals 110 via the variable refrigerant network 116. The home or building and the surrounding environment can be divided into any number of different zones or areas. Each zone can include a terminal 110. A zone can be a portion of a single room, a single room, or several rooms in a building or any structure. The home or building can be divided into zones based on similar demands for heating and cooling, such that one or more rooms having similar demand for heating or cooling of air and/or water during a similar time period can be grouped together in a single zone. A single room can include more than one zone. By way of example, a single room can include a zone having a terminal 110 configured to condition the air and a terminal 110 configured to heat or cool liquid. Alternatively or in addition to, a single room can include a zone having a terminal 110 configured to condition the air in a first portion of the single room and a terminal 110 configured to condition the air in a second portion of the single room.

As illustrated in FIG. 3, an area 302 can be divided into three zones, Zone A, Zone B, and Zone C. Each zone can include a terminal 110. In Zone A and Zone B, the terminals 110 can be configured to condition air in an interior room. In Zone C, the terminal 110 can be configured to heat or cool liquid. Zone C can be an interior room or area of a home or building that includes a water heater as the terminal 110. Alternatively or in addition to, Zone C can be an exterior area of a home or building that includes a pool heater or cooler as the liquid terminal 114. In response to the demand for heated air, the variable refrigerant network 116 can direct a determined supply of vapor refrigerant at a determined flow rate to the terminal 110 located in Zone A In response to a demand for cooled air, the variable refrigerant network 116 can direct a determined supply of liquid refrigerant at a determined flow rate to the terminal 110 location in Zone B. In response to a demand for heated water, the variable refrigerant network 116 can direct a determined supply of vapor refrigerant at a determined flow rate to the terminal in Zone C. Accordingly, the VRF conditioning system 100*b*, 200 can provide simultaneous heating and cooling of air while also providing heating of water.

FIG. 3 illustrates one example configuration of the VRF conditioning system 100*b*, 200. However, it is contemplated that any configuration and any combination of heating and cooling of air in a zone and heating and cooling of liquid can be provided.

Figure 4:
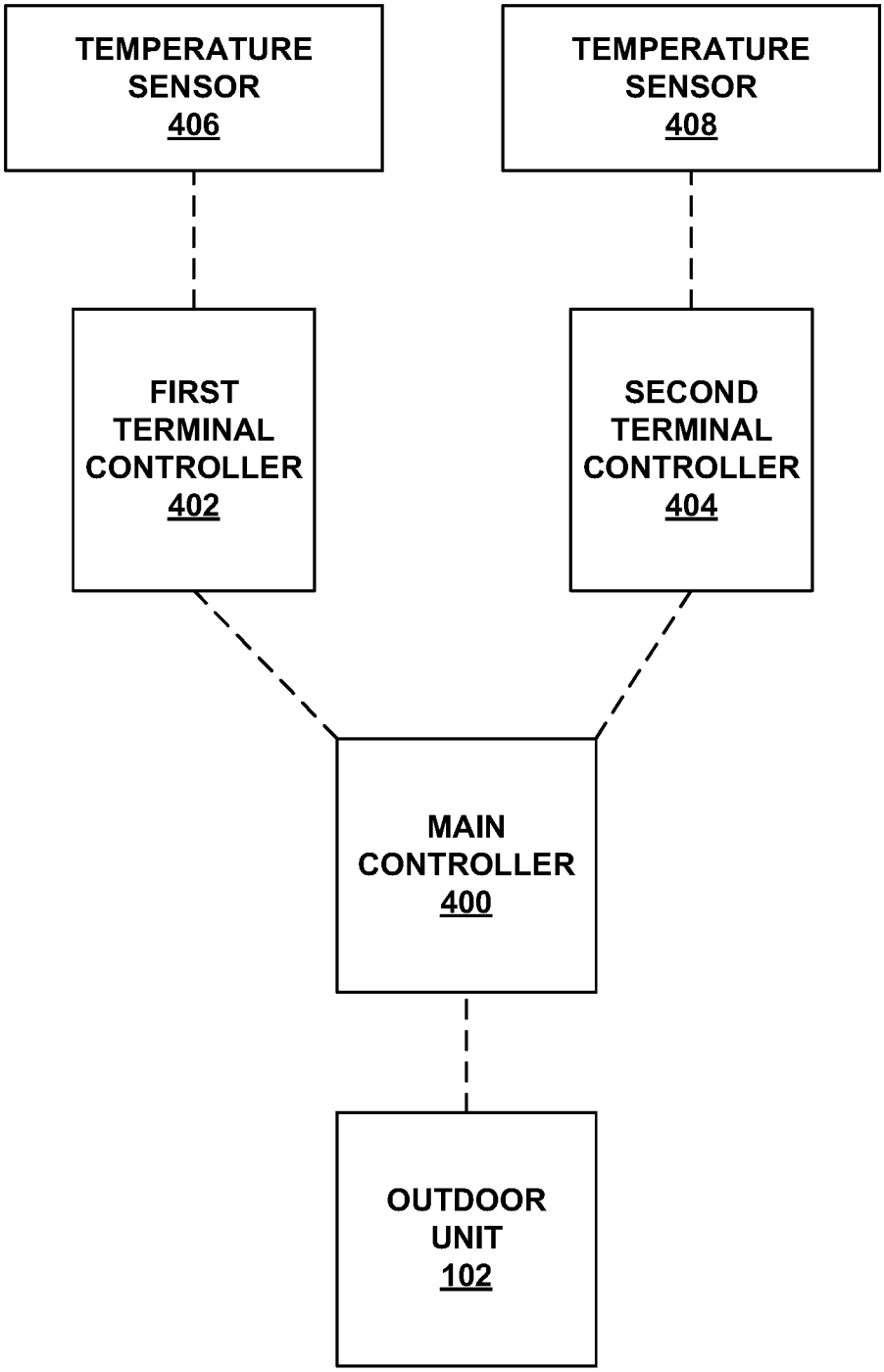
FIG. 4 illustrates an example main controller in communication with various components of a VRF conditioning system, in accordance with the disclosed technology.

FIG. 4 illustrates an example main controller 400 configured to control the operations of the VRF conditioning systems 100, 200. The main controller 400 can be in electrical communication with various components of the VRF conditioning systems 100, 200. The controller 400 can receive signals from the various components of the VRF conditioning systems 100, 200 and output instructions to the various components in response.

As illustrated in FIG. 4, the main controller 400 can be in electrical communication with an air terminal controller 402 and a liquid terminal controller 404. The air terminal controller 402 can be in electrical communication with one or more temperature sensors 406 and the liquid terminal controller 404 can be in electrical communication with one or more temperature sensors 408. The main controller 400 can further be in electrical communication with the outdoor unit 102. In this configuration, the air terminal 112 and the liquid terminal 114 can be controlled from a single location by the main controller 400.

The air terminal controller 402 and the liquid terminal controller 404 can be configured receive signals from the main controller 400 regarding operation of the air terminal 112 and the liquid terminal 114, respectively. The air terminal controller 402 and the liquid terminal controller 404 can be configured to send signals to the main controller 400 indicating a demand of the air terminal 112 and the liquid terminal 114, respectively. The air terminal 112 can include one or more temperature sensors 406. The temperature sensor 406 can determine the current temperature of the interior air in which the air terminal 112 is located. The liquid terminal 114 can include one or more temperature sensors 408. The temperature sensor can determine the current temperature of the water stored via the liquid terminal 114. The temperature sensors 406, 408 can send signals indicating the determined current temperatures to the first terminal controller 402 and the second terminal controller 404. Alternatively or in addition to, the air terminal 112 and/or the liquid terminal 114 can include additional sensors configured to detect humidity, carbon dioxide, or other parameters. The additional sensors can send signals indicating determined parameters to the first terminal controller 402 and the second terminal controller 404. Because the air terminal 112 and the liquid terminal 114 each include an individual controller 402, 404, independent control of the conditioning of air via the air terminal 112 and heating or cooling of liquid via the liquid terminal 114 can be provided.

The air terminal controller 402 and the liquid terminal controller 404 can receive instructions regarding operation of the air terminal 112 and the liquid terminal 114, respectively. The instructions can include a pre-set temperature or pre-set range of temperature of interior air for the zone in which the air terminal 112 is located, a pre-set temperature or pre-set range of temperature of water being outputted by the liquid terminal 114. The instructions can include a pre-set temperature or pre-set range of temperature of interior air for the zone in which the air terminal 112 is located during a pre-set time period and a pre-set temperature or pre-set range of temperature of water being outputted by the liquid terminal 114 during a pre-set time period. The instructions can include a desired mode of operation and/or a desired mode of operation during a pre-set time period. The air terminal controller 402 and the liquid terminal controller 404 can each include a user interface such that a user can input instructions. The user can input instructions based on a desired comfort level. Based on the inputted instructions and the temperatures determined by the temperature sensors 406, 408, the air terminal controller 402 and the liquid terminal controller 404 can send demand signals to the main controller 400. By way of example, the air terminal controller 402 can determine the inputted instructions indicate a pre-set interior air temperature for the zone in which the air terminal 112 is located is lower than the current temperature of the interior room determined by the temperature sensor 406. In response, the air terminal controller 402 can send a signal to the main controller 400 that the air terminal 112 is indicating a demand for cooling. The liquid terminal controller 404 can determine the inputted instructions indicate a pre-set water temperature is higher than the current temperature of the water within the liquid terminal 114 determined by the temperature sensor 408. In response, the liquid terminal controller 404 can send a signal to the main controller 400 that the liquid terminal 114 is indicating a demand for heating. If the VRF conditioning system is not configured to provide simultaneous heating and cooling (e.g. VRF conditioning system 100*a*) and the air terminal 112 indicates a demand for cooled air while the liquid terminal 114 indicates a demand heated water, the main controller 400 can determine the demand from which terminal 112, 114 should be satisfied first. That is, the controller 400 can output signals to the outdoor unit 102, the air terminal controller 402, and the liquid terminal controller 404 to operate according to the priority determination. As a non-limiting example, the controller 400 can receive user inputted priority instructions regarding whether to operate the air terminal 112 or the liquid terminal 114 first when the air terminal 112 and the liquid terminal 114 indicate different demands. As another non-limiting example, the controller 400 can formulate a priority determination based on a calculated energy efficiency; that is, the controller 400 can determine that it would be more energy efficient to first address the demand for the air terminal 112 and subsequently address the demand for the liquid terminal 114, or vice versa.

The main controller 400 can be configured to modulate a supply of refrigerant and flow rate of refrigerant to each terminal 110 based on the indicated demands to continuously and precisely control the temperature of interior air and water. Based on the demand signals from the air terminal controller 402 and the liquid terminal controller 404, the main controller 400 can output instructions to the outdoor unit 102 and various components of the outdoor unit 102. In response to the demands indicated by the air terminal controller 402 and the liquid terminal controller 404, the speed of the compressor 106 can be varied. By way of example, when multiple terminals 110 in a VRF conditioning system 100, 200 indicate a heating demand, the speed of the compressor 206 can be increased such that a greater supply of refrigerant can be delivered. Alternatively or in addition to, the speed of the fan 104 can be varied in response to the demands of the air terminal 112 and the second terminal. By increasing or decreasing the fan 104, the supply of refrigerant delivered to each of the terminals 110 can correspondingly increase or decrease.

The air terminal controller 402 and the liquid terminal controller 404 can be in electrical communication with the branch circuit controller 118 and/or the branch selector 206. The air terminal controller 402 and the liquid terminal controller 404 can send signals to the branch circuit controller 118 and/or the branch selector 206 based on the indicated demands of each terminal 110. In response, the branch circuit controller 118 and/or the branch selector 206 can modulate the supply of refrigerant and flow rate of refrigerant to each terminal 110.

The electrical communication network between the main controller 400, the outdoor unit 102, the air terminal controller 402, and the liquid terminal controller 404 can allow the variable refrigerant network 116 to direct only the necessary supply of refrigerant at a determined flow rate to each terminal 110 based on the indicated demand such that the VRF conditioning system can operate efficiently.

Although FIG. 4 illustrates the example mam controller 400 in electrical communication with the air terminal controller 402, the liquid terminal controller 404, and the outdoor unit 102 such that the communication corresponds to a particular VRF conditioning system arrangement, it is contemplated that the controller 400 can be in communication with any number of controllers corresponding to the number of terminals and any number of outdoor units corresponding to the number of outdoor units.

Figure 5:
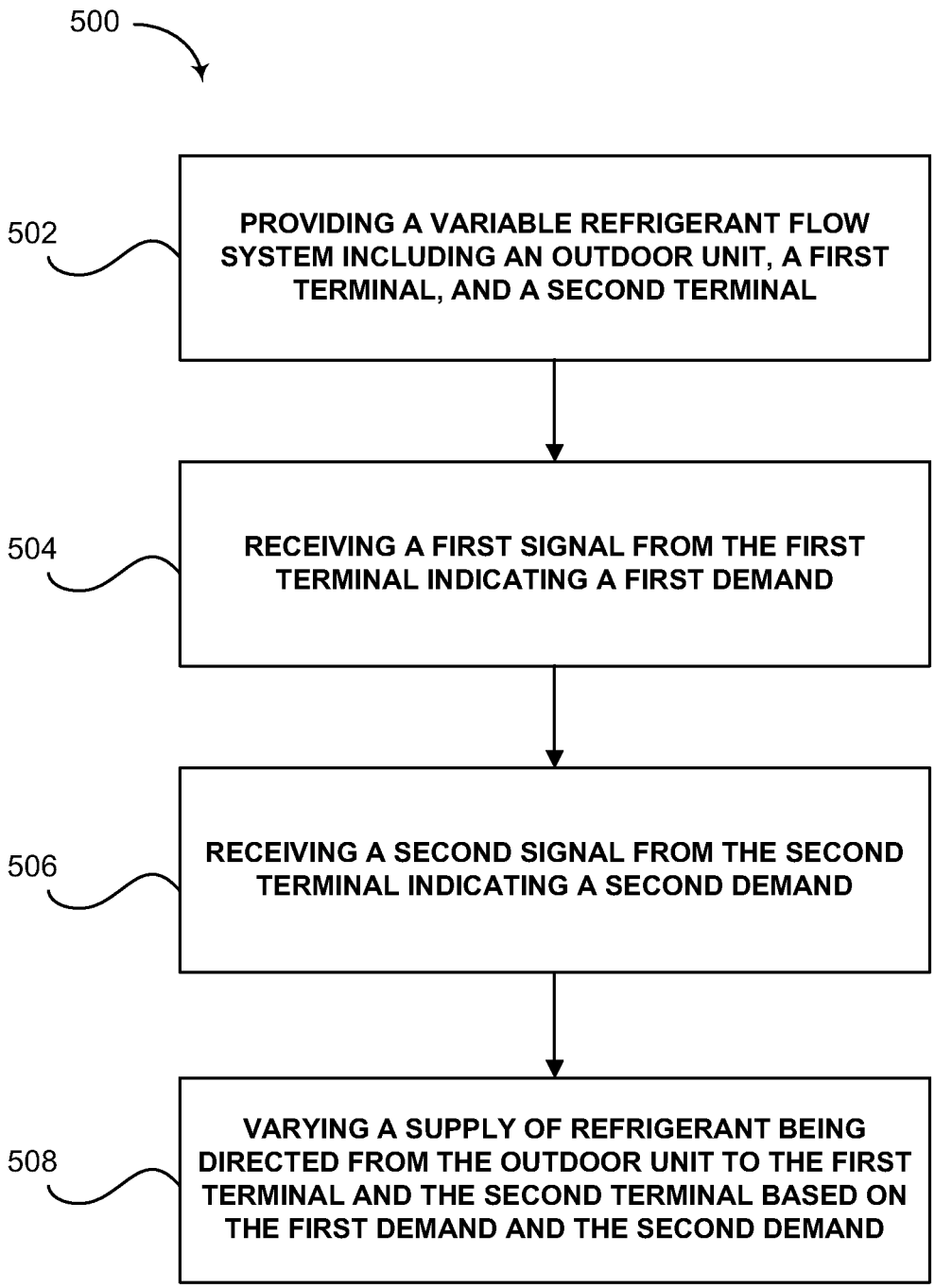
FIG. 5 illustrates a flow diagram outlining the steps for varying a supply of refrigerant, in accordance with the disclosed technology.

FIG. 5 illustrates a flow diagram outlining a method 500 of varying the supply of refrigerant. The method 500 can include providing 502 a variable refrigerant flow system 100, 200 including an outdoor unit 102, a first terminal 112, and a second terminal 114. The first terminal 112 can be configured to condition air and the second terminal 114 can be configured to heat and/or cool liquid.

The method 500 can include receiving 504 a first signal from the first terminal 112 indicating a first demand. The first terminal controller 402 can output the first signal indicating the first demand, and the main controller 400 can receive the first signal. The method 500 can include receiving 506 a second signal from the second terminal 114 indicating a second demand. The second terminal controller 404 can output the second signal indicating the second demand, and the main controller 400 can receive the second signal.

The method 500 can include varying 508 a supply of refrigerant being directed from the outdoor unit 102 to the first terminal 112 and the second terminal 114 based on the first demand and the second demand.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

The invention claimed is:

1. A variable refrigerant flow (VRF) conditioning system comprising:

an outdoor unit comprising a compressor, a condenser coil, and a fan;

a water heater coupled to the outdoor unit;

a first air conditioning unit coupled to the outdoor unit; and a controller configured to:

determine that a cooling operation mode is active during a first time interval;

cause vapor refrigerant to be directed from the outdoor unit to the water heater and liquid refrigerant to be directed from the outdoor unit to the first air conditioning unit, such that the water heater heats water and the first air conditioning unit simultaneously outputs cooled air during the first time interval;

determine that a heating operation mode is active during a second time interval; and cause the vapor refrigerant to be directed from the outdoor unit to both the water heater and the first air conditioning unit, such that the water heater heats the water and the first air conditioning unit simultaneously outputs heated air during the second time interval.

2. The VRF conditioning system of claim 1, wherein the controller is further configured to:

cause, during the first time interval, heat energy extracted from the liquid refrigerant to be directed to the water heater.

3. The VRF conditioning system of claim 1, further comprising:

a second air conditioning unit coupled to the outdoor unit, wherein the second air conditioning unit is configured to operate in an air heating mode and an air cooling mode independent of the first air conditioning unit.

4. The VRF conditioning system of claim 1, further comprising:

a VRF network comprising a vapor refrigerant conduit, a liquid refrigerant conduit, and a return refrigerant conduit, the VRF network extending between the outdoor unit, the water heater, and the first air conditioning unit;

wherein the water heater is a first terminal of the VRF network, and the first air conditioning unit is a second terminal of the VRF network.

5. The VRF conditioning system of claim 4, wherein the VRF network is a three-pipe network.

6. The VRF conditioning system of claim 4, wherein the VRF network further comprises:

a branch selector component configured to:

separate a mixture of refrigerant into the vapor refrigerant and the liquid refrigerant, wherein the mixture is being directed from the outdoor unit to the branch selector component.

7. The VRF conditioning system of claim 6, wherein the branch selector component is configured to direct the vapor refrigerant to the second terminal when the first air conditioning unit is heating air, and to direct the liquid refrigerant to the second terminal when the first air conditioning unit is cooling air.

8. The VRF conditioning system of claim 1, wherein the outdoor unit is a single outdoor unit.

9. The VRF conditioning system of claim 1, wherein the water heater has a plurality of predetermined temperature set points.

10. The VRF conditioning system of claim 1, wherein the controller is further configured to:

cause the water heater to operate in a water heating mode at a predetermined scheduled time.

11. The VRF conditioning system of claim 1, wherein the water heater is configured to heat or cool water for a pool.

12. The VRF conditioning system of claim 1, wherein the water heater is positioned in a first interior area of a building and the first air conditioning unit is positioned in a second interior area of the building, the second interior area being different than the first interior area.

13. The VRF conditioning system of claim 1, wherein the water heater is a heat pump water heater.

14. A variable refrigerant flow (VRF) conditioning system comprising:

an outdoor unit comprising a compressor, a condenser coil, and a fan;

a water heater coupled to the outdoor unit;

a first air conditioning unit coupled to the outdoor unit;

a second air conditioning unit coupled to the outdoor unit, wherein the second air conditioning unit is configured to operate in an air heating mode and an air cooling mode independent of the first air conditioning unit; and a controller configured to:

determine that a cooling operation mode is active during a first time interval;

cause vapor refrigerant to be directed from the outdoor unit to the water heater and liquid refrigerant to be directed from the outdoor unit to the first air conditioning unit, such that the water heater heats water and the first air conditioning unit simultaneously outputs cooled air during the first time interval;

determine that a heating operation mode is active during a second time interval; and cause the vapor refrigerant to be directed from the outdoor unit to both the water heater and the first air conditioning unit, such that the water heater heats the water and the first air conditioning unit simultaneously outputs heated air during the second time interval.

15. The VRF conditioning system of claim 14, wherein the controller is further configured to:

cause, during the first time interval, heat energy extracted from the liquid refrigerant to be directed to the water heater.

16. The VRF conditioning system of claim 14, wherein the outdoor unit is a single outdoor unit.

17. The VRF conditioning system of claim 14, wherein the water heater has a plurality of predetermined temperature set points.

18. The VRF conditioning system of claim 14, wherein the controller is further configured to:

cause the water heater to operate in a water heating mode at a predetermined scheduled time.

19. A variable refrigerant flow (VRF) conditioning system comprising:

an outdoor unit comprising a compressor, a condenser coil, and a fan;

a water heater coupled to the outdoor unit;

a first air conditioning unit coupled to the outdoor unit; and a controller configured to:

determine that a cooling operation mode is active during a first time interval;

cause vapor refrigerant to be directed from the outdoor unit to the water heater and liquid refrigerant to be directed from the outdoor unit to the first air conditioning unit, such that the water heater heats water and the first air conditioning unit simultaneously outputs cooled air during the first time interval;

determine that a heating operation mode is active during a second time interval;

cause the vapor refrigerant to be directed from the outdoor unit to both the water heater and the first air conditioning unit, such that the water heater heats the water and the first air conditioning unit simultaneously outputs heated air during the second time interval; and cause, during the first time interval, heat energy extracted from the liquid refrigerant to be directed to the water heater.

20. The VRF conditioning system of claim 19, further comprising:

a second air conditioning unit coupled to the outdoor unit, wherein the second air conditioning unit is configured to operate in an air heating mode and an air cooling mode independent of the first air conditioning unit.

* * * * *